United States Patent [19]

Overbeck

[11] Patent Number: 4,928,638

[45] Date of Patent: May 29, 1990

[54] VARIABLE INTAKE MANIFOLD

[76] Inventor: Wayne W. Overbeck, 329 Ingalls St., Santa Cruz, Calif. 95060

[21] Appl. No.: 406,368

[22] Filed: Sep. 12, 1989

[51] Int. Cl.[5] ..... F02M 35/00

[52] U.S. Cl. ..... 123/52 M

[58] Field of Search ..... 123/52 M, 52 MV, 52 MC, 123/52 MB

[56] References Cited

U.S. PATENT DOCUMENTS

| | | | |
|---|---|---|---|
| 1,926,019 | 9/1933 | Aseltine | 123/52 M |
| 3,157,467 | 11/1964 | Daigh et al. | 123/574 |
| 3,875,918 | 4/1975 | Loynd | 123/52 M |
| 3,964,457 | 6/1976 | Coscia | 123/339 |
| 4,180,041 | 12/1979 | Miyazaki et al. | 123/590 |
| 4,391,246 | 7/1983 | Kawabata et al. | 123/391 |
| 4,461,732 | 7/1984 | Foley | 123/391 |
| 4,862,840 | 9/1989 | Matsunaga et al. | 123/52 MC |

*Primary Examiner*—David A. Okonsky
*Attorney, Agent, or Firm*—Jeffrey A. Hall

[57] ABSTRACT

A variable intake manifold characterized by a variable cross-section bladder disposed within the engine's intake manifold. The degree of inflation of the bladder, and consequently the degree of occlusion of the cross-sectional flow path available for the fuel/air mixture within the manifold, is controlled by a pressure or vacuum device connected to a control unit. The control unit is adapted to receive status signals relating to the engine temperature, the throttle conditions, the engine speed in revolutions per minute (RPM) and manifold vacuum. These signals are processed by the control unit and result in various signals being delivered to the pressure-vacuum providing mechanisms which modify the degree of inflation of the bladder in accordance with the parameter status conditions.

9 Claims, 2 Drawing Sheets

VARIABLE INTAKE MANIFOLD

FIELD OF THE INVENTION

The present invention relates to internal combustion engines and more particularly to devices for modifying and improving the delivery of the fuel/air mixture to the combustion chambers of cylinders.

BACKGROUND OF THE INVENTION

In recent times much attention has been focused on maximizing the efficiency of internal combustion engines in regard to the rapid decline of fossil fuel resources. Improvements have been made in the aerodynamic design of automobiles, the lessening of the total weight and also in the field of improving the engine design itself.

One of the areas which has been explored in improving the efficiency of engine performance is related to the fuel/air mixture delivery systems. Since a mixture of fuel and air is delivered into the combustion chamber, it is desirable to optimize the mixture composition and the efficiency of delivery to provide for most efficient burning in the combustion chamber.

Generally, as is well known in the art, intake manifolds for passenger cars and commercial vehicles such as racing cars, are made of either cast aluminum or built up of aluminum tubing. Thus the crosssectional areas of these intake manifolds are essentially constant and generally invariable under all engine operating conditions.

The fixed cross-sectional area of such manifolds contributes to inefficient engine operation and the concomitant pollution from exhaust emissions, such as carbon monoxide, carbon dioxide, oxides of nitrogen, sulfer dioxide, and various hydrocarbons.

Heretofore a wide variety of intake manifolds have been proposed and implemented for internal combustion engines.

The following United States Patents are illustrative of modifications of intake manifolds for a typical four stroke internal combustion engine in order to maximize the efficiency of fuel and air delivery. U.S. Pat. No. 1.926,019, issued to F. E. Aseltine, and U.S. Pat. No. 3,171,395 issued to E. Bartholomew. These devices relate to physical modifications of the intake manifold. A further U.S. Pat. which modifies the intake construction is U.S. Pat. No. 3,875,918 issued to R. S. Loynd. The Loynd patent discloses a flexible tube section in the intake manifold which compresses under vacuum conditions to provide for a narrower fuel mixture path. This increases the mixture velocity and further increases the velocity of the mixture with respect to fuel versus air. This type of manifold is severely limited in application because it is sensitive to internal manifold vacuum levels only, such as high vacuum with a large cross-sectional area. Furthermore, the Loynd manifold cannot maintain optimum mixture velocity throughout the manifold and cannot maintain mixture velocity throughout the entire intake system. These devices disclosed by Aseltine, Bartholomew and Loynd are only responsive to maximizing the fuel delivery efficiency under limited conditions. They are not intended to respond to a variety of engine parameters.

Other methods of attempting to improve the fuel utilization efficiency are described in U.S. Pat. No. 3,964,457 issued to Coscia, U.S. Pat. No. 4,180,041 issued to Miyazaki, et al. and U.S. Pat. No. 4,391,246 issued to Kawabata et al. The Coscia patent discloses a closed loop idle control system that compares the actual engine speed with a reference speed signal and controls the air delivery to the engine to minimize the difference. The Miyazaki, et al. patent utilizes swirl means composed of flow restrictors placed in different positions in the intake passageway promoting the combustable mixture to enter into the cylinder in a tangent direction to the cylinder wall. The Kawabata et al. patent discloses a throttle opener device for internal combustion engines.

Other patents showing methods of attempting to improve the fuel utilization efficiency are described in U.S. Pat. NO. 3,157,467 issued to H. D. Daigh, et al., U.S. Pat. No. 3,077,871 issued to H. D. Daigh, German Patent No. 1,119,047 issued to P. Paschakarnis, and German Patent No. 2,006,739 issued to K. Rinker. The Daigh patents disclose methods for ventilating the crank case in a manner which improves the engines operating efficiency. The devices utilize a variable cross sectional area tube to modify the flow in response to various parameters. The Paschakarnis patent shows a control member for a constant vacuum carurator, having an annular member which is passed centrally by air sucked-in and whose inside diameter varies depending upon the suction generated externally. The Rinker patent relates to carburator modifications where point physical variations in the cross sectional area of the air flow result and are responsive to variations in operating pressure in the engine.

None of these prior art devices address the problems of maximizing the vaporization and delivery speed of fuel to the combustion chambers in response to a variety of engine conditions. Although intake manifold vacuum is to some degree an analog of other factors, it is not sufficient by itself to provide for maximum efficiency. Other factors, such as engine temperature, throttle position and engine speed are also important in determining the degree of modification to be applied to the intake manifold.

SUMMARY OF THE INVENTION

Accordingly, it is a primary object of the present invention to provide a method for maintaining maximum vaporization of the fuel/air mixture and the delivery speed in response to a plurality of engine parameters.

It is a further object of the present invention to provide a device which is easily adapted to existing engines for maximizing their fuel usage efficiency.

It is a further object of the invention to increase the available power output of an engine by decreasing reversion into the intake manifold thereby avoiding dilution of the fuel charge, and also being fully controllable regardless of the vacuum within the intake manifold.

It is a still further object of the present invention to provide a variable control mechanism, which can be modified to adapt to specified conditions, for controlling the fuel utilization optimization components.

Briefly, a preferred embodiment of the present invention is a variable intake manifold system for maintaining proper vaporization of the fuel/air mixture and the velocity of delivery of the mixture to an internal combustion engine cylinder by way of modifying a cross-sectional flow-path of the fuel/air mixture from the throttle body to the cylinder. The system includes a variable cross-section bladder extending along a substantial portion of the intake manifold (and the cylinder port if desired). The degree of inflation of the bladder, and consequently the degree of occlusion of the cross-sectional flow path available for the fuel/air mixture within the manifold, is controlled by a pressure or vacuum sensitive device connected to a control unit. The control unit is designed to receive status signals relating to the engine temperature, the throttle position, the engine speed in revolutions per minute (RPM) and manifold vacuum. These signals are processed by the control board and result in specific signals being delivered to the pressure providing mechanisms which modify the degree of inflation of the bladder in accordance with the parameter status conditions.

An advantage of the present invention is that it permits optimal modification of the flow-path in response to a plurality of engine parameters, in particular, temperature, throttle position, RPM's and vacuum, resulting in greater engine efficiency and power.

A further advantage of the present invention is that it may be installed in the form of a self-sufficient module on existing engines.

Still another advantage of the present invention is that the control board may be reprogrammed or replaced with a different control board in the event that the user wishes to utilize different or a greater number of engine parameters to modify the flow path.

Yet another advantage of this invention is that exhaust emissions of the engine are reduced since the fuel/air mixture is optimized over a large range of conditions.

These and other objects and advantages of the present invention will become apparent upon a reading of the following descriptions and a study of the several figures of the drawing.

DETAILED DESCRIPTION OF THE PREFERRED EMBODIMENT

The preferred embodiment of the present invention is a variable intake manifold system for varying the cross sectional flow path in the intake manifold of an internal combustion engine in a manner designed to maintain optimum vaporization and delivery speed of the fuel/air mixture provided to the combustion chambers of the cylinders. The system includes a manifold module with an inflatable bladder situated therein, pressure control elements for physically controlling the degree of inflation of the bladder, and electronic control components.

Figure 1:
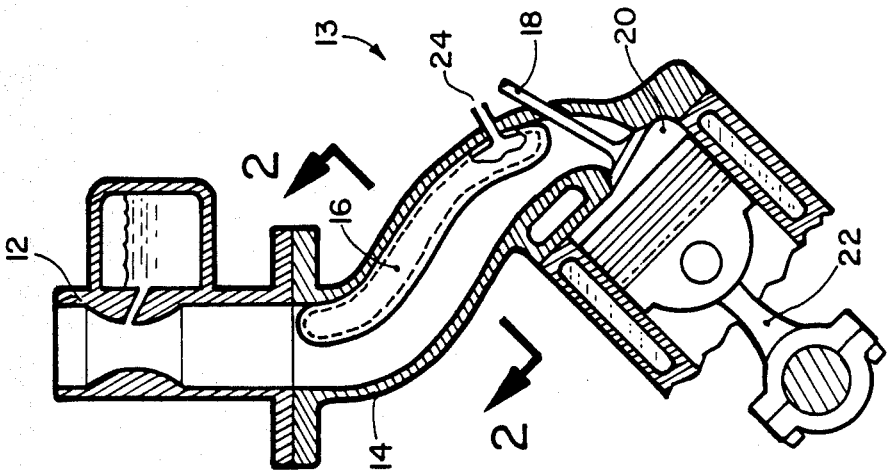
FIG. 1 is a cross sectional view of a typical fuel/air mixture flow path for a piston type internal combustion engine, particularly illustrating the intake manifold.

The intake manifold module and bladder elements of the invention are illustrated in FIG. 1 as installed in the flue flow path of a typical internal combustion engine. The fuel flow path includes a carburetion element 12, an intake manifold module 13 which includes an intake manifold 14 and a bladder 16, and an intake valve 18 into the combustion chamber of cylinder 20, the compression in which is provided by a piston 22.

The bladder 16 is installed within the module 13 so as to be situated in the interior of the intake manifold 14. The bladder 16 extends over a significant portion of the length of the module 13 so as to, at least partially, occlude the mixture flow path therethrough. In FIG. 1 the bladder is shown as partially inflated. At a preselected point on the intake manifold 14 the bladder is provided with a bladder connector 24 which extends through the wall of the intake manifold 14 and provides an access point for delivery and relief of pressure within the bladder 16.

Air, or any other suitable fluid (gaseous or liquid) is pumped into or out of the bladder 16 through the bladder connector 24, as controlled by the control elements of the invention. The amount of fluid within bladder 16 controls the degree of inflation and therefore modifies the cross-sectional area of the flow path of the fuel/air mixture as it passes through the intake manifold 14. The modification of the cross sectional area of the flow path maintains the vaporization of the fuel/air mixture and the speed of delivery to the intake valve 18, and consequently to the combustion chamber of cylinder 20.

Figure 2:
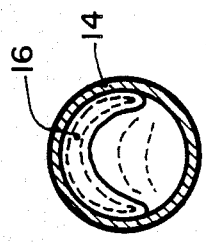
FIG. 2 is a cross sectional view, taken along line 2—2 of FIG. 1, illustrating a circular cross section intake manifold.
Figure 3:
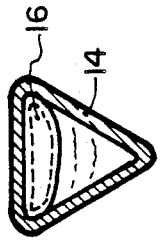
FIG. 3 is a view similar to that of FIG. 2 illustrating a triangular cross section manifold.
Figure 4:
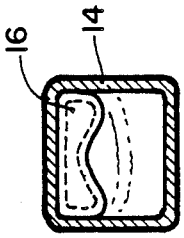
FIG. 4 is a view similar to FIG. 2 illustrating a rectangular cross section manifold.

The manner in which the inflation of the bladder 16 affects the manifold flow path is illustrated in FIGS. 2, 3, and 4. In FIG. 2 the intake manifold 4 is shown as being circular in cross section with a semi-circular cross-section bladder 16. In FIG. 3, the intake manifold 14 is shown to be triangular in cross-section with a triangular cross-section bladder 16 and in FIG. 4, the typical case with most internal combustion engines, the intake manifold 14 is shown as having a rectangular cross-section, in which case a rectangular cross-section bladder 16 is utilized.

Figure 5:
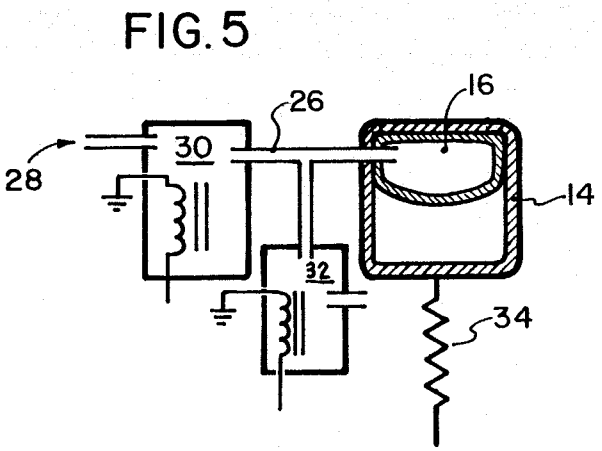
FIG. 5 illustrates, in schematic fashion, the fluid operational elements of the system.

Referring now to FIG. 5, the physical operational elements of the variable intake manifold system are illustrated in schematic fashion. This figure illustrates a typical rectangular cross-section intake manifold 14 shown in cross section. A essentially rectangular cross-section bladder 16 is shown installed flush against one wall of the manifold 14 according to the preferred embodiment. The bladder 16 is connected by way of the bladder connector 24 to pressure lines 26 extending outside of the manifold 14. One branch of the pressure line 26 is connected to a fluid source may be either a pressure source or a vacuum source, depending on the preferred manner of inflating or deflating the bladder 16. In the preferred embodiment, the fluid selected is ordinary air and the fluid source 28 is a pressure source in the form of an air compressor. The air compressor 28 is connected to the pressure line 26 leading to the bladder 16 by a pressure valve 30 interposed therein. The pressure valve 30 is a variable opening valve which may be electrically controlled by the controlling mechanism of the system to allow varying amounts of pressurized air to the bladder 16.

An additional branch of the pressure line 26, interposed between the pressure valve 30 and the bladder 16, extends to a bleeder valve 32. The bleeder valve 32 allows the fluid to escape from the bladder 16, thus allowing the bladder 16 to deflate. Since the bladder 16 is ordinarily selected to be somewhat elastic, the pressure created by the elasticity of the bladder 16 forces the fluid out through the bleed valve 32 and deflates the bladder 16.

FIG. 5 also illustrates a vacuum sensor element 34 which is attached to the intake manifold 14. In the preferred embodiment, the vacuum sensor element 34 is a variable resistor which provides a signal which is directly proportional to the vacuum level inside the manifold 14.

Figure 6:
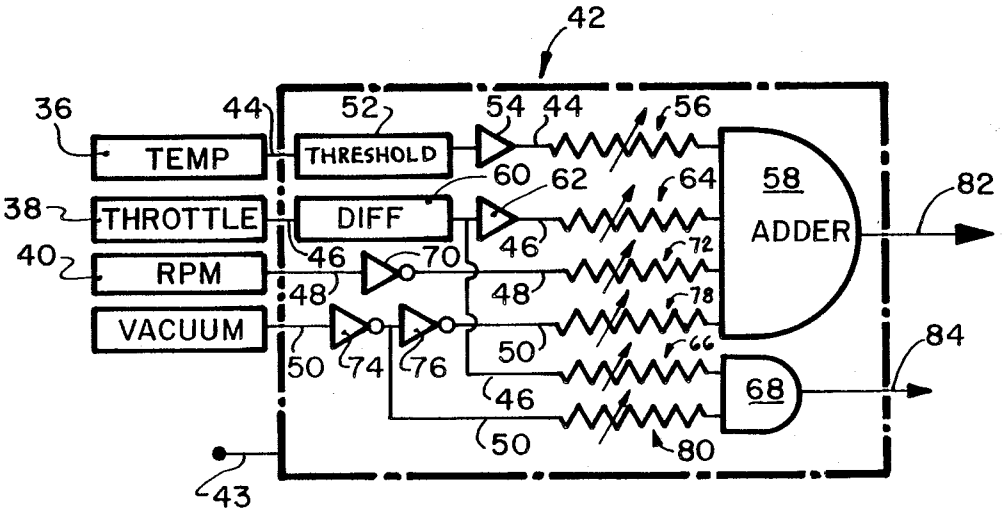
FIG. 6 illustrates, in schematic fashion, the electrical sensing and control elements of the system.

FIG. 6 illustrates the logical and control components of the invention. A series of sensor components deliver analogs of various engine parameter status conditions to the analyzing and control components. The analog delivery components include a temperature sensor 36, a throttle status sensor 38, an engine speed (RPM) status sensor 40, and the vacuum sensor 34.

In the preferred embodiment, the temperature sensing element 36 is a thermocouple type device placed in contact with the engine coolant. Since the engine coolant temperature is directly related to the temperature conditions in the cylinders, this sensor delivers information directly related to the cylinder temperature, a factor important in determining the appropriate mixture richness and delivery speed for maximum efficiency.

The throttle status sensor 38 is typically a mechanical sensor attached to the throttle arm near the point where the throttle arm attaches to the carburetor. The throttle status sensor 38 senses the throttle status, such as extreme open position or extreme closed position, and relays the information to the analyzing and control components.

The engine speed or RPM status sensor 40 is typically an electrical sensor connected to the ignition system. The information delivered by the RPM status sensor 40 is analogous to the rate at which the cylinders 20 are firing.

Each of the status sensors delivers a separate analog signal to a control board 42 which includes the analyzing and control components of the invention. The control board 42 includes a plurality of electrical and electronic components for analyzing and processing the signals generated by the sensor components. The electrical power for the components on the control board 42 is delivered through a power supply input 43.

Each of the sensor inputs is separately processed in the control board 42. The temperature sensor 36 delivers a temperature analog signal 44, the throttle status sensor 38 delivers a throttle status analog signal 46, the RPM status sensor 40 delivers an RPM signal 48 and the vacuum sensor 34 delivers a vacuum analog signal 50. Each of the analog signals is then analyzed and processed within the control board 42, the output of which controls the opening of the pressure valve 30 and the bleeder valve 32.

The temperature analog signal, upon entering the control board 40, passes through a threshold switch 52. Threshold switch 52 is active until the temperature signal reaches a preselected value. In the preferred embodiment it is desired that the bladder be inflated additionally when the coolant temperature is below approximately 82° C. (180° F.) so that the mixture velocity within the manifold is increased. Therefore, the threshold switch 52 remains closed and allows the passage of a signal as long as the incoming temperature analog signal 44 corresponds to the coolant temperature of less than 82° C. (180° F.).

From the threshold switch 52, the temperature analog signal 44 continues through a first buffer 54. The first buffer 54 is typically an operational amplifier which modifies and shapes the signal for appropriate delivery. From the first buffer 54, the signal continues to a first signal weighting network 56. The first signal weighting network 56 is illustrated as being a variable resistor. The variable resistor 56 is necessary to provide appropriate weighting of the temperature, throttle, RPM and vacuum status analog signals, 44, 46, 48, and 50 respectively, for appropriate modification of the bladder inflation in response to changes in the parameters.

After passing through the first variable resistor 56, the temperature analog signal 44 is delivered to a first adder element 58. The first adder 58 combines the weighted signals from each of the sensor elements and delivers an appropriate output signal to the pressure valve 30. The net result is that during low start up temperature conditions the pressure valve 30 opens and the mixture richness and velocity are increased. Then normal operating temperatures are achieved the pressure valve 30 remains unaffected by this parameter.

The throttle status analog signal 46 enters the control board 42 from the throttle status sensor 38. It then passes through a differentiator 60 which weights the signal for rate of change of status as well as for actual status. After the differentiator 60 the throttle status signal 46 divides. One branch is delivered through a first inverter 62 and a second signal weighting network 64 to the first adder 58. The remainder of the signal branches through a third signal weighting network 66 and into a second adder 68. In second adder 68, it is combined with signals from other factors to generate a signal to the bleeder valve 32. First inverter 62, on the signal path for the throttle status signal 46 to first adder 58, causes the pressure delivered to the bladder to be significantly lessened when the throttle is wide open or is increasing rapidly. Concurrently, the remaining branch of the throttle status analog signal 46 is not inverted and thus delivers a signal to second adder 68 which results in more rapid deflation of the bladder 16 and thus increasing the flow path.

The RPM analog signal 48 is delivered from the RPM status sensor 40 to the control board 42. Within the control board 42, it passes through a second inverter 70 and a fourth signal weighting network 72 and is delivered to first adder 58. The RPM status signal 48 is inverted with respect to increasing RPM's since it is desirable that the degree of bladder inflation be decreased as engine speed increases.

The vacuum analog signal 50 is delivered from the vacuum sensor 34 into the control board 42. The vacuum analog signal 50 enters a third inverter 74 and then branches. One arm of the signal path then passes through a fourth inverter 76 and a fifth signal weighting network 78 to enter first adder 58. The remaining branch is delivered through a sixth signal weighting network 80 to second adder 68. The net result is that a high vacuum condition, which corresponds to low engine loading, results in a doubly inverted, or original polarity signal being delivered to the first adder 58 while an inverted signal is delivered to second adder 68. The net result of this is that during vacuum conditions the bladder inflation is increased. Conversely, when the vacuum status is low, corresponding to heavy engine loading, a smaller magnitude signal is delivered to first adder 58 when a greater signal is delivered to second adder 68. This leads to decreased bladder inflation and increased mixture flow path.

The net output signal of the first adder 58 is the weighted combination of the direct temperature analog signal 44 and the direct vacuum analog signal 50 with the inverted throttle status analog signal 46 and the inverted RPM analog signal 48. This net output is in the form of a pressure valve control output 82. Pressure valve control output 82 is delivered to the pressure valve 30. The pressure control output 82 modifies the degree of opening of pressure valve 30.

The output of second adder 68 is the weighted combination of the direct differentiated throttle status analog signal 46 and the inverted vacuum analog signal 50. The combined output forms a bleeder valve control output 84 which is then delivered to control the degree of opening in the bleeder valve 32.

The present invention is installed on an engine by inserting a manifold module 13 in place of a standard intake manifold. It is also possible, although more difficult, to modify an existing manifold to mount a bladder 16 therein. At the present time, the preferred shape of the intake manifold 14 in the module 13 is a triangular cross section manifold such as is shown in FIG. 3. Alternative shapes, however, are within the scope of the invention, for example, a rectangular cross section configuration of the intake manifold 14 in module 13.

The control board 42 is then mounted at some convenient position. The power supply input 43 is connected to the automobile electrical system, or if desired, to a separate power supply. The vacuum sensor 34, temperature sensor 36, throttle status sensor 38 and RPM status sensor 40 are then appropriately connected. At this point, the variable intake manifold system is ready for operation.

The system responds to variations in engine parameters as shown in Table A below.

TABLE A

| Engine Parameter | Parameter Status | Parameter Signal Status | Pressure Valve Opening Response | Bleeder Valve Opening Response | Mixture Velocity Response |
|---|---|---|---|---|---|
| Temperature | less than 180° F. | variable positive | increase | none | increase |
| | more than 180° F. | none | none | none | none |
| Throttle | idle | small steady | increase | decrease | increase |
| | accelerating | variable large | decrease | increase | decrease |
| | full open | steady | close | full open | full decrease |
| Engine Speed | low | small | increase | none | increase |
| (RPM) | high | large | decrease | none | decrease |
| Vacuum | low | small | decrease | increase | decrease |
| | high | large | increase | decrease | increase |

The degree of weighting of the signals for each of the parameters provided by the first through sixth signal weighting networks is determined for the conditions of the particular engine. Generally, the temperature and RPM analog signals 44 and 48, respectively, will be weighted more highly than the throttle analog signal 46 with the vacuum analog signal 50 receiving the least weighting. Those skilled in the art will be able to adjust the variable resistors or other variable signal weighting network components to optimize the response of a particular internal combustion engine.

As is discussed above, various types of intake manifold configurations and corresponding bladder configurations may be utilized with the present invention. The shape is largely a matter of choice of the user. Common materials are used for the intake manifold 14 while the bladder 16 must be of a flexible, fluid-tight material which is resistant to degradation in the presence of gasoline or other fuel components. Although it is preferred that the bladder 16 be elastic, this is not a necessary restriction.

The pressure valve 30 and the bleeder valve 32 may be selected from any of a number of types of valves which have variable openings which may be electrically controlled. Since the bleeder valve 32 is intended to be at least partially open at all times, it must be adjusted in such a manner that it always allows some fluid flow. The fluid selected is also a matter of choice although ordinary air appears to be the most economical and is sufficient for most purposes.

Various types of parameter sensors, other than those described above, may be utilized with the present invention. The control board 42 may be modified or adjusted in accordance with differing types of signals delivered. Furthermore, in the event that a user wishes to incorporate additional or different parameters than those discussed herein, this may be accomplished by modifying the sensors and the control board to incorporate such additional factors. The precise figuration of the components within the control board is also largely a matter of choice, as long as the desired net pressure valve control output 82 and the bleeder valve control output 84 are achieved.

While this invention has been described in terms of a few preferred embodiments, it is contemplated that persons reading the preceding descriptions and studying the drawing will envision various alterations, permutations and modifications thereof. Various alternate embodiments of this invention utilize alternative methods for varying the effective cross-sectional area of a fuel/air delivery conduit by means of a fluid pressure mechanism controlled by engine parameters. For example, the fuel/air mixture could pass through a bladder and the controlling fluid could surround the bladder.

It is therefore intended that the following appended claims be interpreted as including all such alterations, permutations and modifications as fall within the true spirit and scope of the present invention.

What is claimed is:

1. A variable intake manifold system for an internal combustion engine comprising:

an inflatable bladder installed within the intake manifold so as to partially cross sectionally occlude a fuel/air mixture flow path;

means for inflating and deflating the bladder so as to occlude a cross-section of said flow path; and means for controlling the inflating and deflating means in response to preselected engine parameter conditions.

2. The system of claim 1 wherein:

said bladder is similar in inflated cross-section to cross-section of said intake manifold and extends along at least a portion of flow path of said manifold.

3. The system of claim 1 wherein said means for inflating and deflating includes:

a valve controlled pressure supply means for delivering fluid into said bladder in order to inflate said bladder; and a valve controlled fluid outlet for allowing fluid to escape said bladder and allowing said bladder to deflate.

4. The system of claim 1 wherein said means for controlling includes:

sensing means for sensing said preselected parameters and producing analog signals of said parameters;

delivery means for transporting electrical signals within said variable intake manifold system;

analyzing means for comparing, weighting, and combining said analog signals to produce control signals; and flow control means for receiving said control signals and modifying the inflating and deflating means in response thereto.

5. The system of claim 3 wherein the means for controlling includes:

sensing means for sensing said preselected parameters and producing analog signals of said parameters;

delivery means for transporting electrical signals within the system;

analyzing means for comparing, weighting and combining said analog signals to produce control signals; and flow control means receiving said control signals and modifying the inflating and deflating means in response thereto.

6. The system of claim 5 wherein:

said preselected parameters include engine temperature, throttle status, engine speed and intake manifold vacuum.

7. The system of claim 5 wherein said analyzing means comprises a control board including:

separate inputs for independently receiving each of said analog signals;

a first adder for combining preselected, processed analog signals into a pressure valve control output signal, which signal controls the degree of opening of said pressure valve;

a second adder for combining preselected, processed analog signals into an outlet valve control output signal, which signal controls the degree of opening of said outlet valve; and separate signal processing networks for receiving each of said analog signals at said inputs, processing said signals and delivering said processed signals to said first adder and said second adder.

8. The system of claim 7 wherein:

said separate signal processing networks includes signal shaping components and variable signal weighting components.

9. The system of claim 2 wherein:

said intake manifold is selected to have a triangular cross-section.

* * * * *